United States Patent [19]

Spargo

[11] Patent Number: 4,693,054

[45] Date of Patent: Sep. 15, 1987

[54] PROCESS FOR FILLING BEER INTO CONTAINERS

[75] Inventor: William G. Spargo, St. Louis, Mo.

[73] Assignee: Anheuser-Busch, Incorporated, St. Louis, Mo.

[21] Appl. No.: 668,639

[22] Filed: Nov. 6, 1984

[51] Int. Cl.[4] ..... B65B 31/00

[52] U.S. Cl. ..... 53/432; 53/474; 141/6

[58] Field of Search ..... 53/403, 408, 432, 473, 53/474; 141/4, 6, 39, 48

[56] References Cited

U.S. PATENT DOCUMENTS

| | | | |
|---|---|---|---|
| 655,443 | 8/1900 | Keller . | |
| 773,573 | 11/1904 | Koedding . | |
| 2,010,565 | 8/1935 | Schraitle | 226/111 |
| 2,186,526 | 1/1940 | Greiner | 226/115 |
| 3,068,910 | 12/1962 | Jacobs | 141/40 |
| 3,212,537 | 10/1965 | Hinxlage et al. | 53/432 X |
| 3,381,723 | 5/1968 | Quest | 141/39 |
| 3,415,295 | 12/1968 | Wolf | 141/46 |
| 3,460,589 | 8/1969 | Justis | 141/6 |
| 3,463,203 | 8/1969 | Wolf | 141/39 |
| 3,478,785 | 11/1969 | Mallrich et al. | 141/39 |
| 3,486,538 | 12/1969 | Quest et al. | 141/39 |
| 3,699,740 | 10/1972 | Knabe | 53/432 |
| 3,804,133 | 4/1974 | Copping | 53/403 X |
| 3,837,137 | 9/1974 | Yatsushiro et al. | 53/432 |
| 3,878,664 | 4/1975 | Zinke | 53/432 |
| 3,886,982 | 6/1975 | Uth et al. | 141/39 |
| 4,086,943 | 5/1978 | Fernandez | 141/39 |
| 4,124,043 | 11/1978 | Noguchi | 141/39 X |
| 4,342,344 | 8/1982 | Ahlers | 141/39 |
| 4,360,045 | 11/1982 | Ahlers | 141/39 |
| 4,390,048 | 6/1983 | Zelder | 141/6 |

*Primary Examiner*—Robert L. Spruill
*Assistant Examiner*—Steven P. Weihrouch
*Attorney, Agent, or Firm*—Gravely, Lieder & Woodruff

[57] ABSTRACT

The present disclosure involves the filling of beer into containers with a minimum of air/oxygen pickup by forming a layer of displacement gas (normally $CO_2$) in the bottom of the container, discharging beer into the displacement gas adjacent to the bottom and maintaining the layer of displacement gas above the beer as the beer level rises in the container to push the air out of the top of the container through a vent valve or vent restriction and closing the container with little or no foaming of the beer to drive the air out of the headspace above the beer.

5 Claims, 1 Drawing Figure

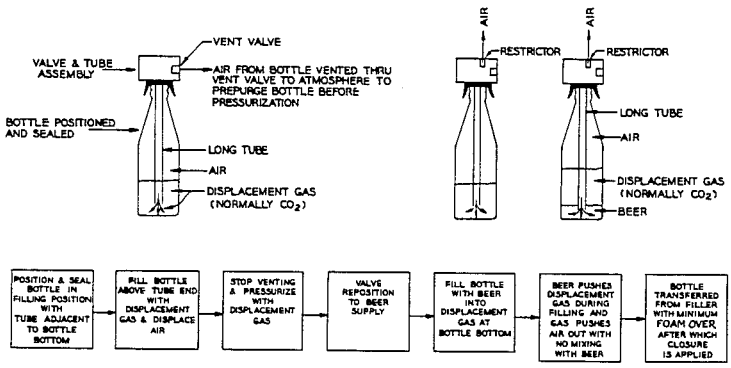

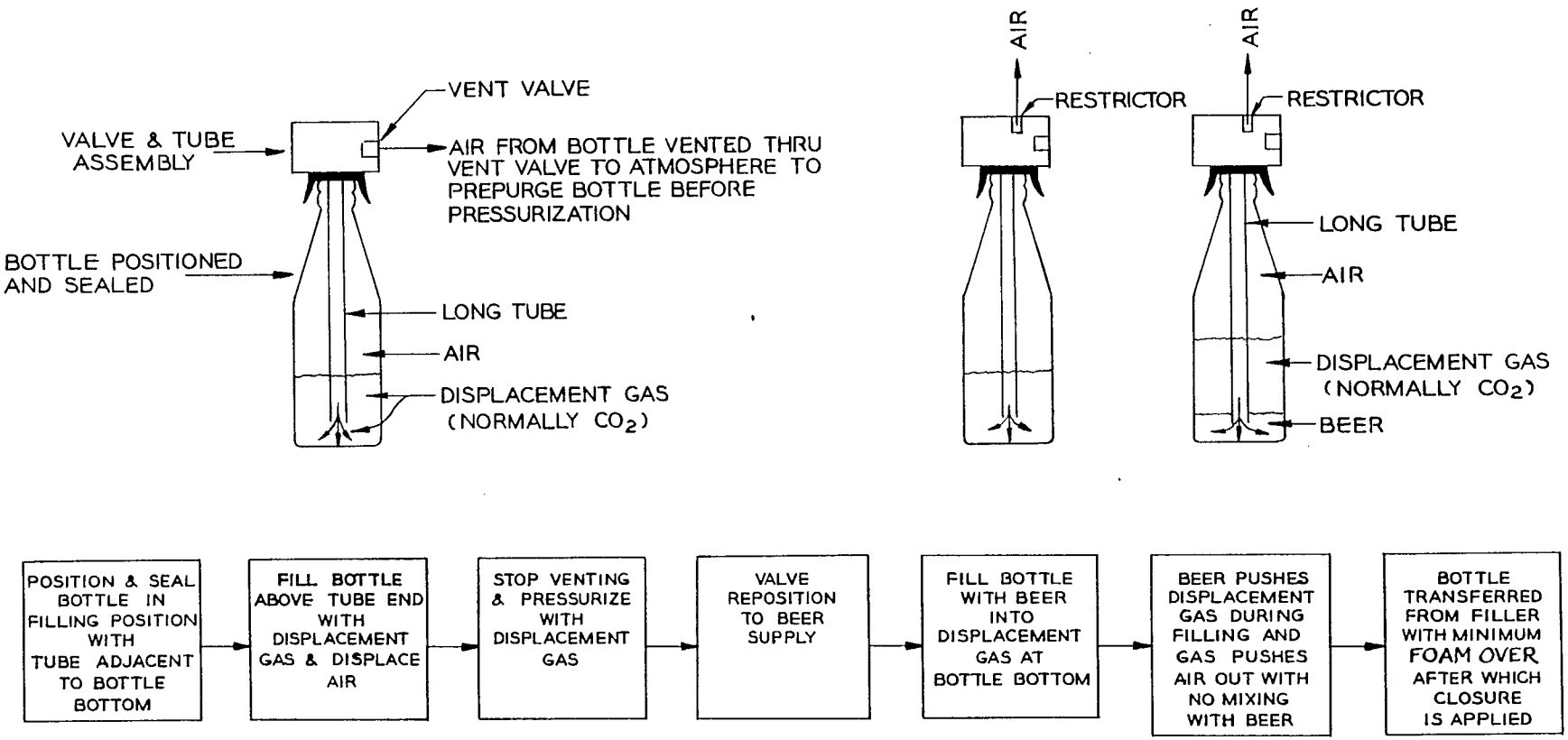
AIR
RESTRICTOR
AIR
RESTRICTOR
LONG TUBE
AIR
DISPLACEMENT GAS (NORMALLY $CO_2$)
BEER
VENT VALVE
AIR FROM BOTTLE VENTED THRU VENT VALVE TO ATMOSPHERE TO PREPURGE BOTTLE BEFORE PRESSURIZATION
LONG TUBE
AIR
DISPLACEMENT GAS (NORMALLY $CO_2$)
VALVE & TUBE ASSEMBLY
BOTTLE POSITIONED AND SEALED
POSITION & SEAL BOTTLE IN FILLING POSITION WITH TUBE ADJACENT TO BOTTLE BOTTOM
FILL BOTTLE ABOVE TUBE END WITH DISPLACEMENT GAS & DISPLACE AIR
STOP VENTING & PRESSURIZE WITH DISPLACEMENT GAS
VALVE REPOSITION TO BEER SUPPLY
FILL BOTTLE WITH BEER INTO DISPLACEMENT GAS AT BOTTLE BOTTOM
BEER PUSHES DISPLACEMENT GAS DURING FILLING AND GAS PUSHES AIR OUT WITH NO MIXING WITH BEER
BOTTLE TRANSFERRED FROM FILLER WITH MINIMUM FOAM OVER AFTER WHICH CLOSURE IS APPLIED

PROCESS FOR FILLING BEER INTO CONTAINERS

BACKGROUND OF THE INVENTION

This invention relates to a method and apparatus for filling bottles, cans or like containers with liquids, and more particularly to improvements in a method and apparatus for filling containers with beer or another liquid which is adversely affected by contact with air-/oxygen.

Presently, when a container is filled with beer, the container normally has an air atmosphere which means it contains a considerable amount of oxygen. Prior to placing carbonated liquid products in a container, the pressure inside the container is increased to an amount commensurate with the amount of carbonation of the product. This pressure is increased by compressed air, $CO_2$ or other gas, producing an environment of compressed air or a mixture of gases, not normally homogenous and always containing oxygen.

When beer is filled into this environment, either with beer entering near the top opening of the container, or with a long tube where it is discharged near the bottom of the container, the beer is discharged into an environment of air or a mixture of gases containing air and consequently picks up an undesirable amount of oxygen. The taste and shelf life of the beer are adversely affected by the oxidation of the beer product in the receptacle.

Generally there are two concepts presently used to minimize oxygen pickup during the bottle filling operation, namely:

1. Empty bottles are supplied to a filling machine and positioned such that each bottle is supplied by a separate filling valve assembly. Gas (usually $CO_2$ or compressed air) is added to each bottle to create a higher pressure in the bottle. After a predetermined pressure has been achieved, beer is caused to flow into the bottle. After an appropriate amount of beer has been filled into the bottle, the valve is closed.

After filling, the pressure in the bottle may or may not be vented to reduce the pressure in the bottle, the bottle and valve are separated, and the bottles removed from the valves. Beer in the bottles is caused to foam and the foam in turn causes air to be expelled from the headspace of the bottles after which a closure is applied to the bottles.

2. The object of an alternate concept is essentially the same as the foregoing except that when the bottles are positioned and sealed on the filler valves, a partial vacuum is drawn on each bottle to remove air from the bottle. After the pre-evacuation of the bottle takes place, gas is introduced into the bottles to establish a higher pressure in the bottle and the filling and closing operations are performed as before.

Both of these procedures have inherent technical characteristics which limit their effectiveness and permit oxygen to be combined with the beer in the receptacle. For example, in the first process, the air in the bottle is compressed at the bottom of the bottle and when beer is discharged into the receptacle, it splashes on the bottom, disperses and picks up oxygen compressed thereat. Also, there is a great loss of beer in the "foaming over" process in which beer in the filled bottle is foamed to expell air from the headspace of the container.

The second, or pre-evacuation process, is difficult to administer and requires greater quantities of expensive gas ($CO_2$) to minimize oxygen pickup. In fact, the vacuum equipment adds to and complicates the filling machine, and increases maintenance costs also.

There are known to us three patents which describe apparatus and processes which, at first glance, appear to have some pertinence to this invention. However, as will be noted hereinafter, each of these patents has considerable differences in concept, operation or structure as compared to the invention of this application.

R. L. Jacobs U.S. Pat. No. 3,068,910 pertains to the filling of metal tanks, primarily for soft drink pre-mix (or other liquids), instead of conventional bottles or cans. The patent also specifically refers to beverages with three and one-half volumes of $CO_2$. This is greater than the carbonation of beer.

According to Jacobs, flexible conduits are detachably connected to a filler bowl and to the tanks to be filled, usually with sanitary quick disconnect fittings. This is considerably different from the construction of a bottle or can filler. The tanks to be filled are handled by pallet loads of approximately 16 tanks per pallet load. This contrasts to the handling of bottles or cans using bottle or can conveyors and without any pallet or pallet load involvement.

In the Jacobs patent the connection to each tank has a beverage control valve controlled by a piston actuated by a manually operated gas control valve. There is also a special venting valve which must be manually attached to the tank after the gas control valve is placed in this vent position, and when a tank has been filled, the detachable conduit is manually disconnected. Bottle and can fillers are completely different and without detachable conduits.

Thus, the Jacobs device is substantially different from my invention in objective, type product to be handled, types of containers, type of container handling, and requires manual connecting and disconnecting of conduits as well as manual actuation of valving.

Justis U.S. Pat. No. 3,460,589 does not provide for prepurging each container prior to counterpressuring and filling.

While Justis states that a specific object of the patent is the provision for fresh $CO_2$ to be injected into the beverage in the container and into the headspace above the beverage at the outset of lowering the container, there is no prepurging of the empty container and such purging as would take place is after the container has been filled with product.

Justis refers to a filling tube of concentric construction with the outer tube having spaced outlets along its length to emit $CO_2$ into the container during the period of removal from the tube. It also refers to an object of the disclosure being to subject the beverage to a charge of $CO_2$. The tube design includes a filling tube with concentric metal sleeves and the drawing shows a tube with a separate tip attached to the concentric metal sleeves.

One primary and unique feature of my invention is the prepurging of air in containers by discharging displacement gas adjacent to the bottom of the container after the container has been properly positioned and sealed. The prepurging is accomplished by the simultaneous venting of air from the upper part of the container through a vent in the filling apparatus to atmosphere at the same time that the displacement gas is emitted from the tube adjacent to the bottom of the container.

From the foregoing, it can be seen that this invention is significantly different from the Justis patent.

Zelder U.S. Pat. No. 4,390,048 is essentially an apparatus used to reproduce gas. This is a separate system from the filling operation, being connected by a gas supply line to the filler and a return gas line and a pressure tap line from a gas supply line regulator to the liquid product supply line. The patent describes in depth the system of separating $CO_2$ from other gases, primarily air/oxygen mixtures, etc. Thus, the Zelder patent itself is completely different from my invention with respect to intent and object.

In the Zelder process, the bottle is first elevated to an intermediate and unsealed position where a gas mixture is used to "rinse" out the container. Further movement by the lift cam elevates the bottle into sealing position where the container is pressurized. Filling of the container with liquid returns the pressuring gas to the aforementioned collection processing system through a return line. A process with an intermediate position of the bottle is complicated and does not afford optimum container handling which is particularly important when the containers are glass bottles, and when large diameter filler tubes are used. In addition, the Zelder process does not provide an optimum position of the end of the tube adjacent to the bottom of the container. As a result of the non-optimum positioning of the tube opening, optimum air removal from the area adjacent to the bottom of the bottle does not occur.

The Zelder patent references a German Offenlegungsschrift patent No. 2,123,255 but states the container filled with atmospheric air is pressurized with an inert gas without previous evacuation, and is then filled with a liquid. This does not involve prepurging of the container.

It is a principal object of this invention to provide a process in which an environment of a displacement gas essentially free of oxygen is provided adjacent to the bottom of a container prior to pressurizing the container and the start of product entering the container, thus to limit the amount of exposure of the product to oxygen and to limit the oxygen pickup of the product.

A further object of the invention is to provide a method of filling containers with carbonated liquid in which a filler tube is positioned in the container so that it terminates at a location adjacent to the bottom of the container, with the opening of said container in proper position and sealed, and then gas of normally high $CO_2$ percentage is directed through the fill tube into the area adjacent to the bottom of the container from the end of the tube prior to pressurizing the bottle and filling it with beer.

Another object is to provide a fill tube having a large diameter end opening so that the gas enters the container at a low velocity so as to effectively displace the air upwardly toward the top of the container and thus provide a blanket of displacement gas adjacent to the bottom of the container. The container is vented to allow the air to be discharged from the upper part of the container through a vent valve to the atmosphere as the container is filled with displacement gas (normally $CO_2$).

A further object is to provide a method of filling into the bottom of a container with substantially oxygen free displacement gas, venting the air from the container, pressurizing the container, and filling beer into the atmosphere of oxygen free gas at the bottom of the container through the same tube as was used to prepurge and pressurize the container, while simultaneously restricting outflow of the gas as the container is filled with beer.

Still another object of this invention is to provide a method of filling beer into a pressurized container with minimum oxygen pickup by the beer in which the air is pushed out the top of the container and first through a vent valve and later a restrictor, by displacement gas (normally $CO_2$) entering the bottom of the container. After a predetermined quantity of the air has been vented, the container is counterpressured to a predetermined level after which the beer is admitted into the bottom of the container so that the beer is filled into an environment of the predominately displacement gas.

Still another object of the invention is to minimize, and preferably eliminate, the product foam-over usually required to expell air from the headspace of the container. Foam-over results in the loss of substantial amounts of beer and there may be disposal problems created by the discarded beer.

These and other objects and advantages will become apparent hereinafter.

SUMMARY OF THE INVENTION

The invention provides a process for reducing oxygen pickup in beer by providing a blanket of substantially oxygen free gas normally dominated by $CO_2$ in the bottom of a container, venting the air from the container through the top of the container and a vent valve as the displacement gas flows into the bottom of the container, and, after pressurizing the container, filling the beer into the pressurized gas at the bottom of the container.

BRIEF DESCRIPTION OF THE DRAWING

The drawing is a flow sheet representing the process of this invention.

DETAILED DESCRIPTION

The flow sheet shows schematically the process of this invention as applied to the filling of bottles with beer using a long tube.

In the first step of the process, the beer bottles are centered and sealed beneath a beer filler valve assembly using a long tube which extends to a position adjacent to the bottom of the bottle.

The tube then is connected through the valve to a source of substantially oxygen free displacement gas (normally $CO_2$) which is discharged through the tube into the bottom of the bottle. The top of the bottle is sealed by the filler valve assembly and vented through a vent valve to atmosphere and therefore, as the displacement gas enters the bottom of the bottle it forms a blanket of displacement gas and displaces the air, so that the air is forced out of the top of the bottle and through the vent valve as it is being filled with the displacement gas. This prepurging occurs at a low pressure at or near atmospheric pressure.

After a predetermined amount of air has been displaced from the bottle, venting from the top of the bottle is terminated by closing the vent valve and allowing the displacement gas to continue to flow into the bottle, causing the pressure inside the bottle to increase to a predetermined level, usually at or slightly below the pressure in the bowl which holds the beer. The amount of prepurging may be limited to minimize displacement gas consumption. The amount of prepurging must be sufficient to provide a satisfactory blanket of displacement gas in the bottom of the bottle to satisfy the need for the initial beer flow to at least cover the tip of the tube, and also be sufficient to displace the air from the headspace of the container when the filling operation is completed, to avoid or minimize the need for beer foaming conventionally used to displace the air in the headspace.

When the pressure reaches a predetermined amount in the bottle, the filling valve is switched from the displacement gas supply to the beer supply and beer is allowed to flow into the bottom of the bottle at a rate controlled by the restriction of the air/gas mixture leaving the bottle into the relatively pure blanket of displacement gas. As the beer enters into the bottom of the bottle from the end of the long tube, it pushes the blanket of displacement gas up toward the top of the bottle and the air and some displacement gas leaves the bottle.

The beer is constantly filling into a substantially oxygen free environment of displacement gas or beer environment and above the beer is the relatively oxygen free displacement gas blanket. When the bottle has been filled to a predetermined level the beer flow is stopped and the filled bottle is transferred from the filler and receives a closure. As the beer is flowing through the tube and into the bottle, the beer level in the bottle rises, raising the blanket of displacement gas which in turn pushes the air above the blanket of displacement gas out the top of the bottle through either the vent valve or vent restriction. Depending upon the air/oxygen content of the beer and/or displacement gas blanket above the beer now located in the headspace of the bottle as well as the requirements of the packager, it may or may not be necessary to cause the beer to foam over to effect a more nearly perfect removal of air from the bottle.

Thus, the conventional foam-over of beer to expel the air in the headspace is substantially reduced or eliminated so that this beer loss associated with the filling operation is minimized or preferably eliminated.

This present invention is not restricted to the specific disclosure of the specification and drawings, but also encompasses modifications and variations apparent to those skilled in the art within the scope of the claims.

What is claimed is:

1. The method of filling containers with a carbonated beverage which comprises the steps of:

(a) positioning a container having an open top and an interior bottom therebelow, filled with air at atmospheric pressure, in a fixed, sealed position relative to a filling head having tube means of large diameter extending downwardly from the filling head into the container so that the bottom end of the filling tube means is at a fixed height closely adjacent to and directed toward the interior bottom of the container, the filling head having a source of substantially oxygen free gas which is at a predetermined pressure greater than atmospheric and a source of beverage which is substantially at the said predetermined pressure;

(b) prepurging the container by flowing substantially oxygen free gas from the source thereof through the filling tube means while venting the upper end of the container through valve means to ambient atmosphere so that the substantially oxygen free gas is directed at low velocity toward the bottom of the container while the container is in the position of step "a" until a substantially pure blanket of the substantially oxygen free gas has grown in thickness from the bottom to a level above the fixed height of the bottom end of the filling tube, has displaced the air in the container upwardly above the fixed height, and has forced air outwardly to ambient atmosphere through the vent valve;

(c) terminating the valved venting of the interior of the container while continuing the flowing of the substantially oxygen free gas from the source thereof until the interior of the container is substantially at the predetermined pressure of the source of the substantially oxygen free gas;

(d) discontinuing the flowing of the substantially oxygen free gas from the source thereof, thereafter flowing the beverage from its source through the tube means into the bottom of the container while restricting flow of air from the container to control the flow rate of the beverage into the container so that the beverage is filled into an environment of the relatively pure blanket of the oxygen free gas to limit the amount of exposure of the beverage to oxygen and limit the air/oxygen pickup of the beverage while maintaining the predetermined pressure within the container; and (e) terminating the flow of the beverage into the container when it is filled, separating the filling head from the container, and then closing the container.

2. The process of claim 1 wherein the beverage is beer.

3. The process of claim 2 wherein the beer is filled into the container until it reaches a predetermined height and the container is closed with minimum foaming of the beer.

4. The process of claim 2 wherein the gas is $CO_2$.

5. The process of claim 1 wherein the gas is $CO_2$.

* * * * *